US008057003B2

(12) United States Patent
Hasenbein et al.

(10) Patent No.: US 8,057,003 B2
(45) Date of Patent: Nov. 15, 2011

(54) METHOD AND APPARATUS TO PROVIDE VARIABLE DROP SIZE EJECTION WITH A LOW POWER WAVEFORM

(75) Inventors: Robert Hasenbein, Enfield, NH (US); Samuel E. Darby, North Andover, MA (US)

(73) Assignee: Fujifilm Dimatix, Inc., Lebanon, NH (US)

( * ) Notice: Subject to any disclaimer, the term of this patent is extended or adjusted under 35 U.S.C. 154(b) by 228 days.

(21) Appl. No.: 12/126,622

(22) Filed: May 23, 2008

(65) Prior Publication Data

US 2009/0289981 A1 Nov. 26, 2009

(51) Int. Cl.
*B41J 29/38* (2006.01)

(52) U.S. Cl. ..... 347/11; 347/15; 347/54; 347/68; 347/69

(58) Field of Classification Search ..... None
See application file for complete search history.

(56) References Cited

U.S. PATENT DOCUMENTS

| | | | | |
|---|---|---|---|---|
| 6,290,315 | B1 | 9/2001 | Sayama | |
| 6,328,395 | B1 | 12/2001 | Kitahara et al. | |
| 6,357,846 | B1 * | 3/2002 | Kitahara | 347/10 |
| 6,378,972 | B1 | 4/2002 | Akiyama et al. | |
| 6,676,238 | B2 | 1/2004 | Fujimura et al. | |
| 6,755,511 | B1 * | 6/2004 | Moynihan et al. | 347/68 |
| 7,281,778 | B2 | 10/2007 | Hasenbein et al. | |
| 2006/0164450 | A1 | 7/2006 | Hoisington et al. | |
| 2006/0181557 | A1 | 8/2006 | Hoisington et al. | |
| 2007/0076022 | A1 * | 4/2007 | Takizawa | 347/5 |
| 2008/0074451 | A1 | 3/2008 | Hasenbein et al. | |
| 2008/0170088 | A1 | 7/2008 | Letendre et al. | |
| 2009/0179934 | A1 * | 7/2009 | Takagi et al. | 347/15 |

OTHER PUBLICATIONS

PCT International Search Report and Written Opinion for PCT International Appln No. PCT/US2009/043622, mailed on Sep. 30, 2009 (6 pages).

Notification Concerning Transmittal of International Preliminary Report on Patentability and Written Opinion of the International Searching Authority pertaining to PCT/US2009/043622, mailed on Dec. 2, 2010, pp. 5 total.

* cited by examiner

*Primary Examiner* — Matthew Luu
*Assistant Examiner* — Justin Seo
(74) *Attorney, Agent, or Firm* — Blakely, Sokoloff, Taylor & Zafman LLP

(57) ABSTRACT

In one embodiment, a method for driving a droplet ejection device having an actuator includes applying a low power multi-pulse waveform having at least two drive pulses and at least one intermediate portion to the actuator. The method further includes alternately expanding and contracting a pumping chamber coupled to the actuator in response to the at least two drive pulses and the at least one intermediate portion. The method further includes causing the droplet ejection device to eject one or more droplets of a fluid in response to the pulses of the low power multi-pulse waveform. In some embodiments, at least one intermediate portion has a voltage level greater than zero and less than or equal to a threshold voltage level in order to reduce the power needed to operate the droplet ejection device.

20 Claims, 12 Drawing Sheets

METHOD AND APPARATUS TO PROVIDE VARIABLE DROP SIZE EJECTION WITH A LOW POWER WAVEFORM

TECHNICAL FIELD

Embodiments of the present invention relate to droplet ejection, and more specifically to using a low power waveform for variable drop size ejection.

BACKGROUND

Droplet ejection devices are used for a variety of purposes, most commonly for printing images on various media. They are often referred to as ink jets or ink jet printers. Drop-on-demand droplet ejection devices are used in many applications because of their flexibility and economy. Drop-on-demand devices eject one or more droplets in response to a specific signal, usually an electrical waveform, or waveform, that may include a single pulse or multiple pulses. Different portions of a multi-pulse waveform can be selectively activated to produce the droplets.

Droplet ejection devices typically include a fluid path from a fluid supply to a nozzle path. The nozzle path terminates in a nozzle opening from which drops are ejected. Droplet ejection is controlled by pressurizing fluid in the fluid path with an actuator, which may be, for example, a piezoelectric deflector, a thermal bubble jet generator, or an electrostatically deflected element. A typical printhead has an array of fluid paths with corresponding nozzle openings and associated actuators, and droplet ejection from each nozzle opening can be independently controlled. In a drop-on-demand printhead, each actuator is fired to selectively eject a droplet at a specific target pixel location as the printhead and a substrate are moved relative to one another. A droplet's mass is distributed in the head and tail of the droplet. The head of the droplet lands on the target initially with the tail of the droplet subsequently landing on the target. Because drop-on-demand ejectors are often operated with either a moving target or a moving ejector, variations in droplet velocity lead to variations in position of drops on the media. These variations can degrade image quality in imaging applications and can degrade system performance in other applications. Variations in droplet volume and mass lead to variations in spot size in images, or degradation in performance in other applications.

BRIEF DESCRIPTION OF THE DRAWINGS

The present invention is illustrated by way of example, and not by way of limitation, in the figures of the accompanying drawings and in which.

DETAILED DESCRIPTION

Described herein is a method and apparatus for driving a droplet ejection device with low power multi-pulse waveforms. A method for driving a droplet ejection device having an actuator includes applying a low power multi-pulse waveform having at least two drive pulses and at least one intermediate portion to the actuator. The method further includes alternately expanding and contracting a pumping chamber coupled to the actuator in response to the at least two drive pulses and the at least one intermediate portion. In one embodiment, the pumping chamber expands in response to drive pulses and contracts in response to intermediate portions. The method further includes causing the droplet ejection device to eject one or more droplets of a fluid in response to the pulses of the multi-pulse waveform. In the case of a single droplet, the droplet can be formed of one or more sub-drops depending on the number of pulses in the multi-pulse waveform, and the sub-drops can be connected, such that they break-off from the orifice together. The sub-drops may coalesce into a larger droplet before break-off, in flight before reaching a print medium, or on the print medium. In some embodiments, at least one intermediate portion has a voltage level greater than zero and less than or equal to a threshold voltage level in order to reduce the power needed to operate the droplet ejection device. The power needed to eject the fluid is reduced by reducing a total magnitude of voltage changes between the at least two drives pulses and the at least one intermediate portion.

Figure 1:
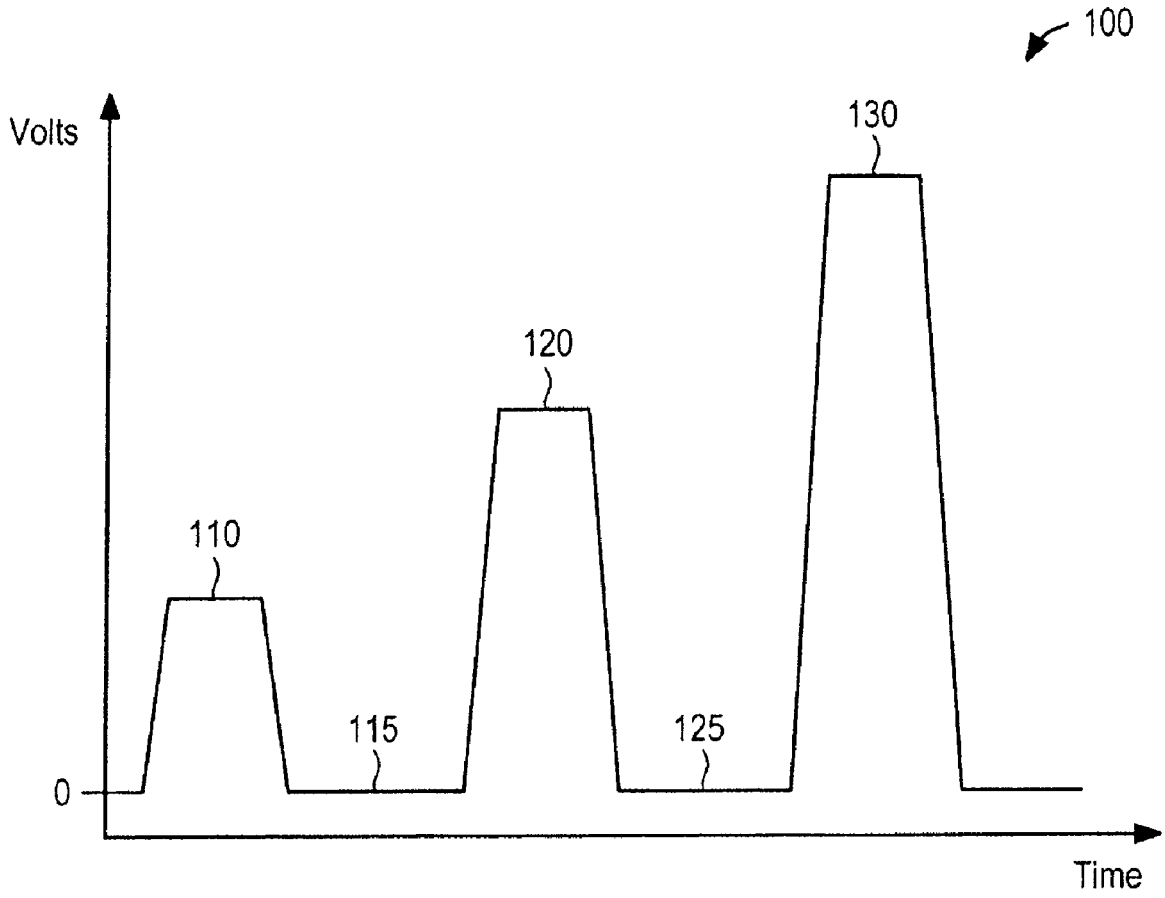
FIG. 1 illustrates a multi-pulse waveform with three drive pulses and two intermediate portions in accordance with a prior approach.

FIG. 1 illustrates a multi-pulse waveform with three drive pulses and two intermediate portions. The multi-pulse waveform 100 includes three drive pulses 110, 120, and 130 and two intermediate portions 115 and 125 as illustrated in FIG. 1. The voltage of the intermediate portions 115 and 125 equals zero. The voltage of the waveform 100 applied to the actuator decreases from a peak voltage of pulse 110 to zero and then increases to a peak voltage of pulse 120. Next, the voltage decreases to zero and then increases to a peak voltage of pulse 130. The waveform 100 operating at a frequency of 14 kilohertz (kHz) can produce an 80 nanogram (ng) drop and consume 26 watts of power.

Figure 2:
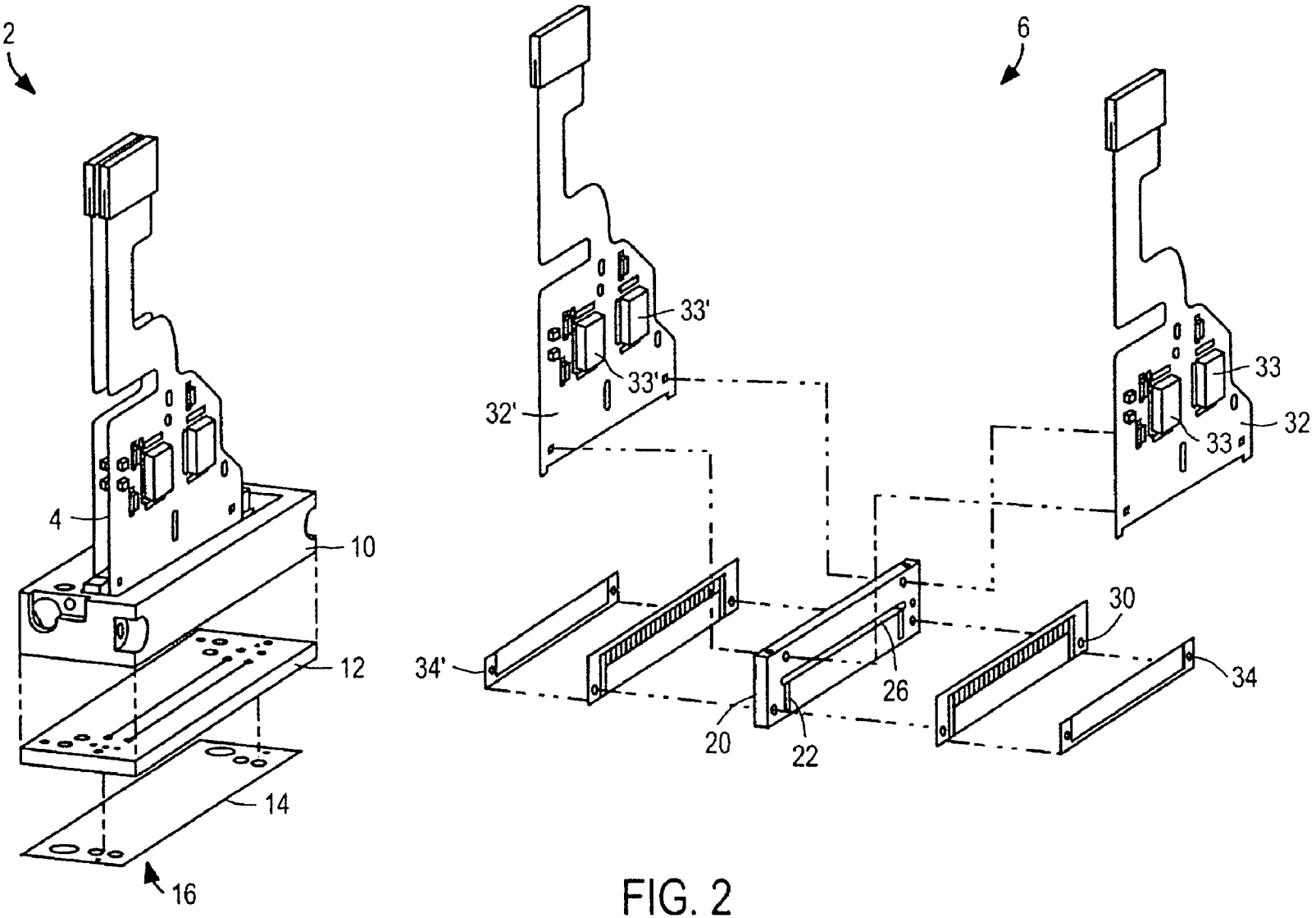
FIG. 2 is an exploded view of a shear mode piezoelectric ink jet print head in accordance with one embodiment.

FIG. 2 is an exploded view of a shear mode piezoelectric ink jet print head in accordance with one embodiment. Referring to FIG. 2, a piezoelectric ink jet head 2 includes multiple modules 4, 6 which are assembled into a collar element 10 to which is attached a manifold plate 12, and an orifice plate 14. The piezoelectric ink jet head 2 is one example of various types of print heads. Ink is introduced through the collar 10 to the jet modules which are actuated with multi-pulse waveforms to jet ink droplets of various droplet sizes (e.g., 30 nanograms, 50 nanograms, 80 nanograms) from the orifices 16 on the orifice plate 14 in accordance with one embodiment. Each of the ink jet modules 4, 6 includes a body 20, which is formed of a thin rectangular block of a material such as sintered carbon or ceramic. Into both sides of the body are machined a series of wells 22 which form ink pumping chambers. The ink is introduced through an ink fill passage 26 which is also machined into the body.

The opposing surfaces of the body are covered with flexible polymer films 30 and 30' that include a series of electrical contacts arranged to be positioned over the pumping chambers in the body. The electrical contacts are connected to leads, which, in turn, can be connected to flex prints 32 and 32' including driver integrated circuits 33 and 33'. The films 30 and 30' may be flex prints. Each flex print film is sealed to the body 20 by a thin layer of epoxy. The epoxy layer is thin enough to fill in the surface roughness of the jet body so as to provide a mechanical bond, but also thin enough so that only a small amount of epoxy is squeezed from the bond lines into the pumping chambers.

Each of the piezoelectric elements 34 and 34', which may be a single monolithic piezoelectric transducer (PZT) member, is positioned over the flex prints 30 and 30'. Each of the piezoelectric elements 34 and 34' have electrodes that are formed by chemically etching away conductive metal that has been vacuum vapor deposited onto the surface of the piezoelectric element. The electrodes on the piezoelectric element are at locations corresponding to the pumping chambers. The electrodes on the piezoelectric element electrically engage the corresponding contacts on the flex prints 30 and 30'. As a result, electrical contact is made to each of the piezoelectric elements on the side of the element in which actuation is effected. The piezoelectric elements are fixed to the flex prints by thin layers of epoxy.

Figure 3:
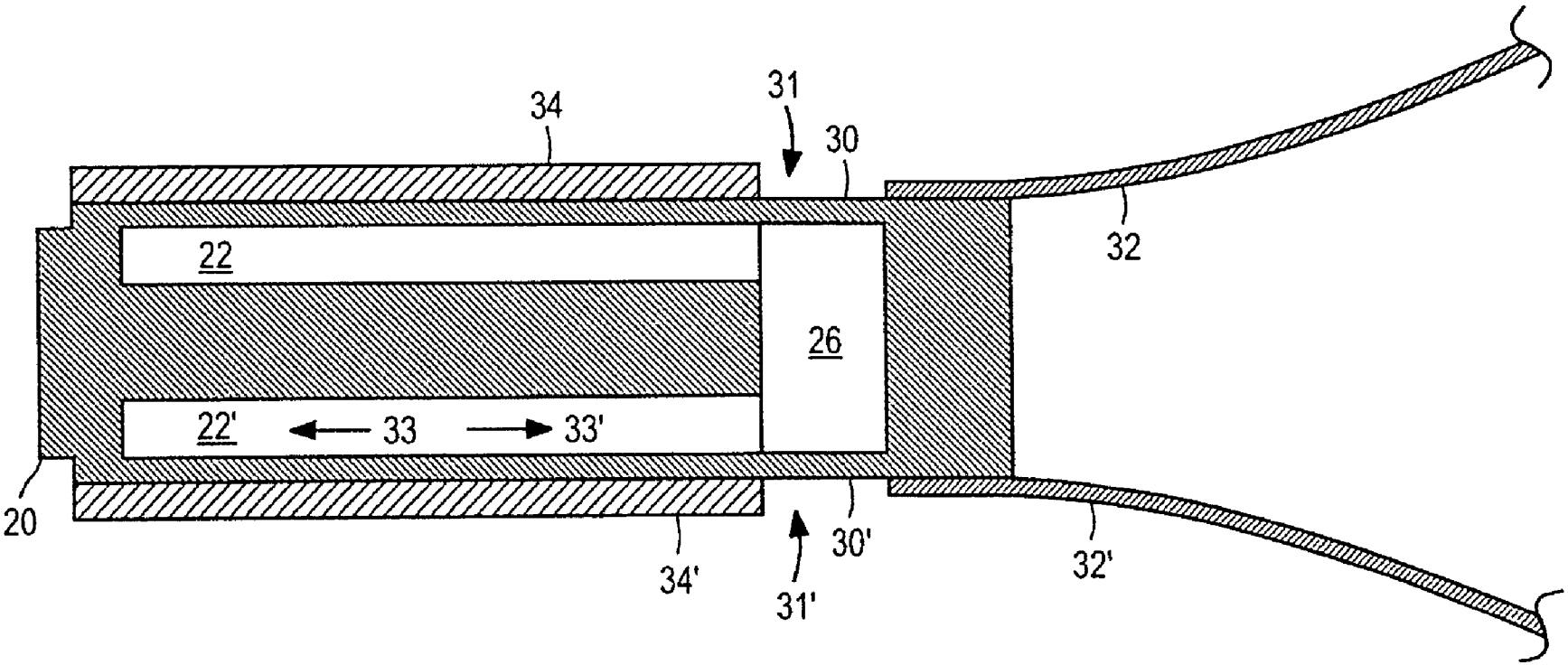
FIG. 3 is a cross-sectional side view through an ink jet module in accordance with one embodiment.

FIG. 3 is a cross-sectional side view through an ink jet module in accordance with one embodiment. Referring to FIG. 3, the piezoelectric elements 34 and 34' are sized to cover only the portion of the body that includes the machined ink pumping chambers 22. The portion of the body that includes the ink fill passage 26 is not covered by the piezoelectric element.

The ink fill passage 26 is sealed by a portion 31 and 31' of the flex print, which is attached to the exterior portion of the module body. The flex print forms a non-rigid cover over (and seals) the ink fill passage and approximates a free surface of the fluid exposed to atmosphere.

Crosstalk is unwanted interaction between jets. The firing of one or more jets may adversely affect the performance of other jets by altering jet velocities or the drop volumes jetted. This can occur when unwanted energy is transmitted between jets.

In normal operation, the piezoelectric element is actuated first in a manner that increases the volume of the pumping chamber, and then, after a period of time, the piezoelectric element is deactuated so that it returns to its original position. Increasing the volume of the pumping chamber causes a negative pressure wave to be launched. This negative pressure starts in the pumping chamber and travels toward both ends of the pumping chamber (towards the orifice and towards the ink fill passage as suggested by arrows 33 and 33'). When the negative wave reaches the end of the pumping chamber and encounters the large area of the ink fill passage (which communicates with an approximated free surface), the negative wave is reflected back into the pumping chamber as a positive wave, traveling towards the orifice. The returning of the piezoelectric element to its original position also creates a positive wave. The timing of the deactuation of the piezoelectric element is such that its positive wave and the reflected positive wave are additive when they reach the orifice.

Figure 4:
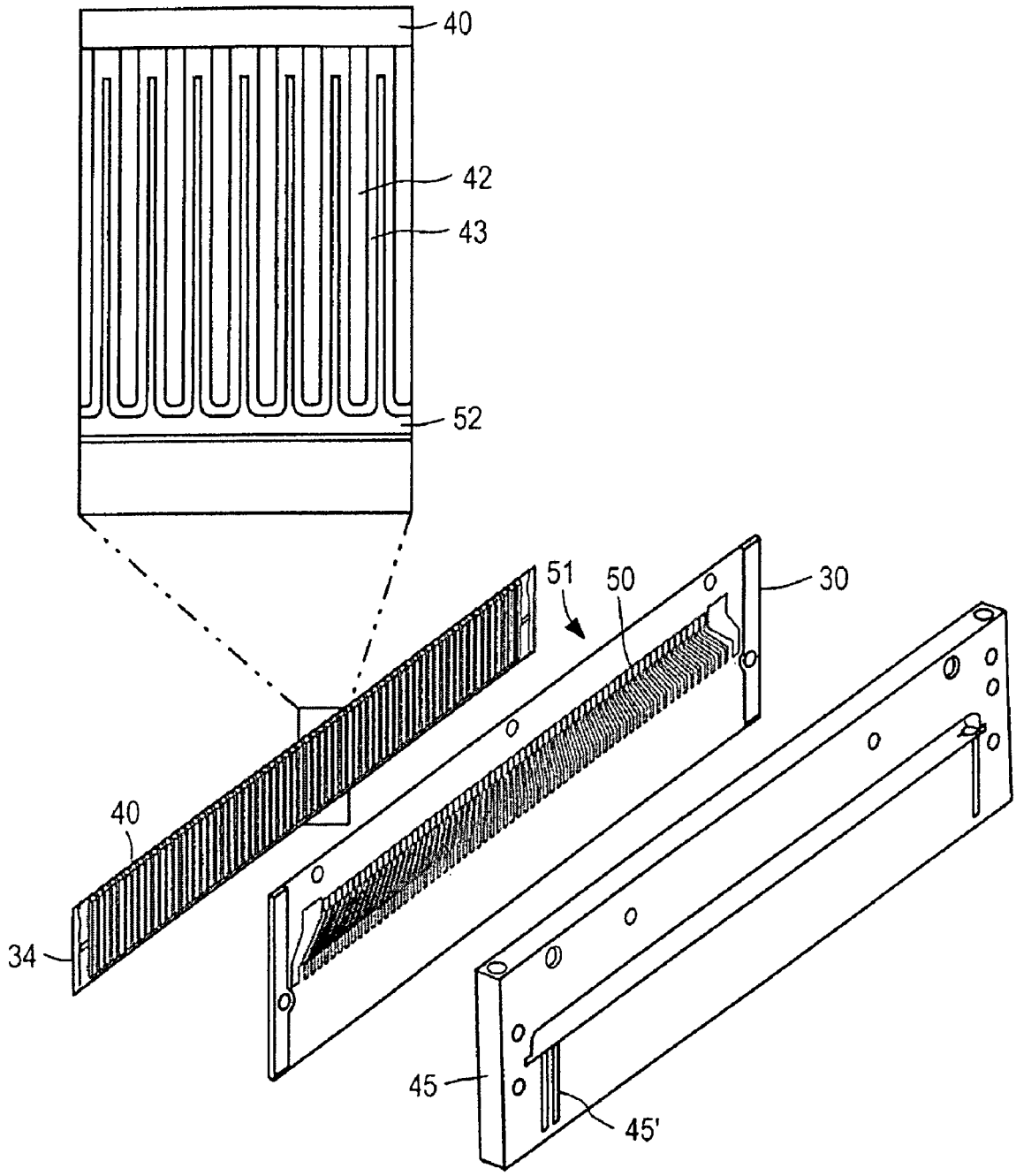
FIG. 4 is a perspective view of an ink jet module illustrating the location of electrodes relative to the pumping chamber and piezoelectric element in accordance with one embodiment.

FIG. 4 is a perspective view of an ink jet module illustrating the location of electrodes relative to the pumping chamber and piezoelectric element in accordance with one embodiment. Referring to FIG. 4, the electrode pattern 50 on the flex print 30 relative to the pumping chamber and piezoelectric element is illustrated. The piezoelectric element has electrodes 40 on the side of the piezoelectric element 34 that comes into contact with the flex print. Each electrode 40 is placed and sized to correspond to a pumping chamber 45 in the jet body. Each electrode 40 has an elongated region 42, having a length and width generally corresponding to that of the pumping chamber, but shorter and narrower such that a gap 43 exists between the perimeter of electrode 40 and the sides and end of the pumping chamber. These electrode regions 42, which are centered on the pumping chambers, are the drive electrodes. A comb-shaped second electrode 52 on the piezoelectric element generally corresponds to the area outside the pumping chamber. This electrode 52 is the common (ground) electrode.

The flex print has electrodes 50 on the side 51 of the flex print that comes into contact with the piezoelectric element. The flex print electrodes and the piezoelectric element electrodes overlap sufficiently for good electrical contact and easy alignment of the flex print and the piezoelectric element. The flex print electrodes extend beyond the piezoelectric element (in the vertical direction in FIG. 4) to allow for a soldered connection to the flex print 32 that contains the driving circuitry. It is not necessary to have two flex prints 30 and 32. A single flex print can be used.

Figure 5B:
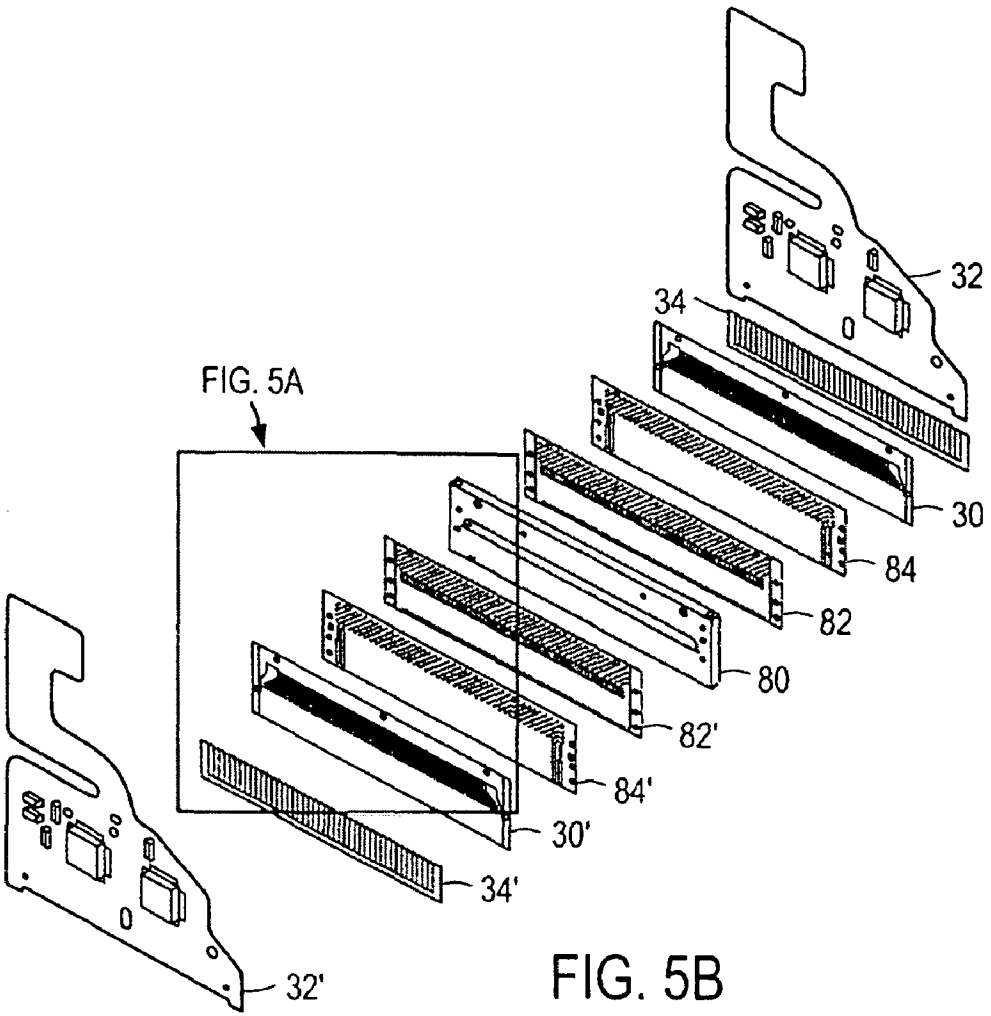
FIG. 5A is an exploded view of another embodiment of an ink jet module illustrated in FIG. 5B.
Figure 5A:
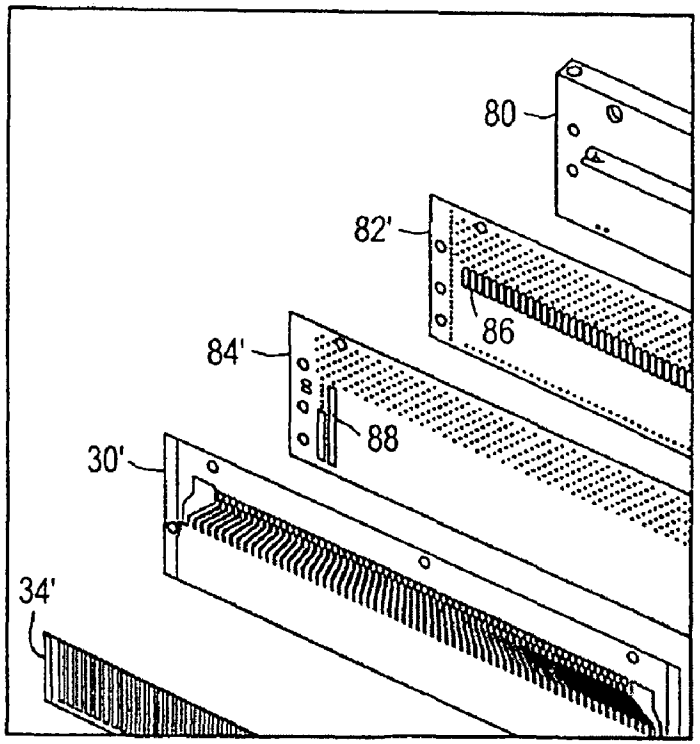

FIG. 5A is an exploded view of another embodiment of an ink jet module illustrated in FIG. 5B. In this embodiment, the jet body is comprised of multiple parts. The frame of the jet body 80 is sintered carbon and contains an ink fill passage. Attached to the jet body on each side are stiffening plates 82 and 82', which are thin metal plates designed to stiffen the assembly. Attached to the stiffening plates are cavity plates 84 and 84', which are thin metal plates into which pumping chambers have been chemically milled. Attached to the cavity plates are the flex prints 30 and 30', and to the flex prints are attached the piezoelectric elements 34 and 34'. All these elements are bonded together with epoxy. The flex prints that contain the drive circuitry 32 and 32', are attached by a soldering process.

Figure 6:
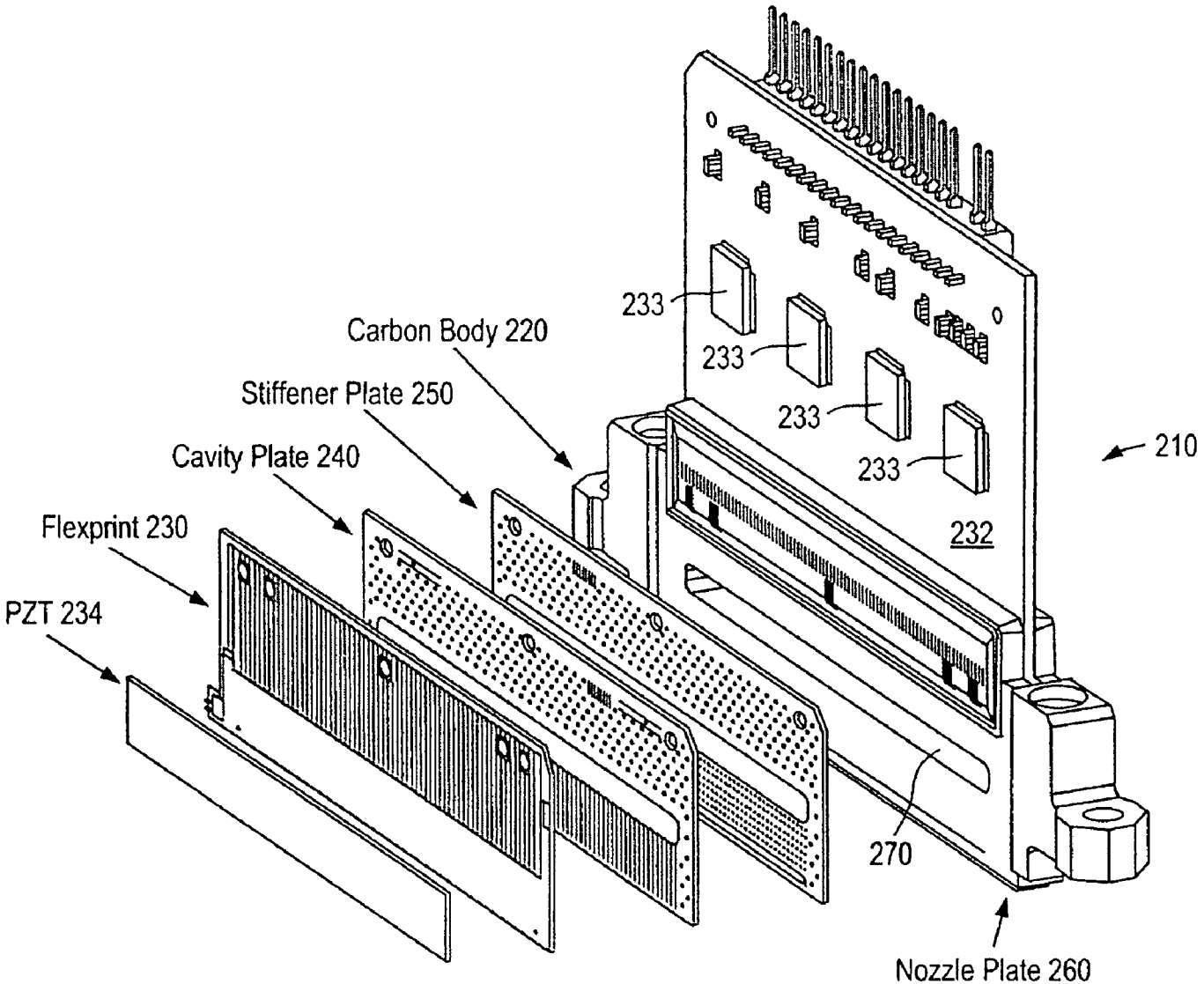
FIG. 6 is a shear mode piezoelectric ink jet print head in accordance with another embodiment.

FIG. 6 is a shear mode piezoelectric ink jet print head in accordance with another embodiment. The ink jet print head illustrated in FIG. 6 is similar to the print head illustrated in FIG. 2. However, the print head in FIG. 6 has a single ink jet module 210 in contrast to the dual ink jet modules 4 and 6 in FIG. 2. In some embodiments, the ink jet module 210 includes the following components: a carbon body 220, stiffener plate 250, cavity plate 240, flex print 230, PZT member 234, nozzle plate 260, ink fill passage 270, flex print 232, and drive electronic circuits 233. These components have similar functionality as those components described above in conjunction with FIGS. 2-5.

Figure 7:
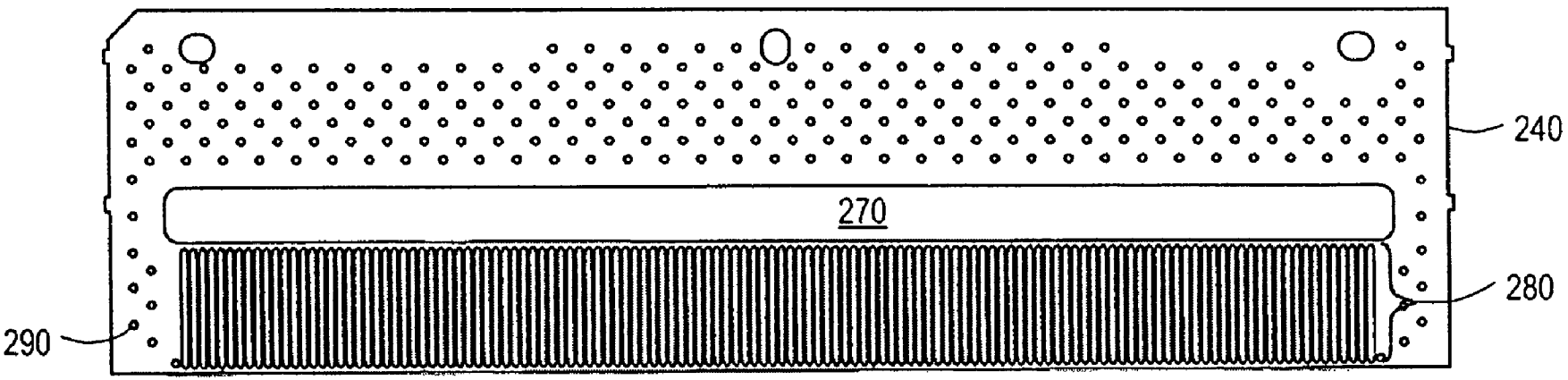
FIG. 7 is a perspective view of an ink jet module illustrating a cavity plate in accordance with one embodiment.

A cavity plate is illustrated in more detail in FIG. 7 in accordance with one embodiment. The cavity plate 240 includes holes 290, ink fill passage 270, and pumping chambers 280 that are distorted or actuated by the PZT 234. The ink jet module 210 which may be referred to as a droplet ejection device includes a pumping chamber as illustrated in FIGS. 6 and 7. The PZT member 234 (e.g., actuator) operates to vary the pressure of fluid in the pumping chambers in response to the drive pulses applied to the drive electronics 233. For one embodiment, the PZT member 234 ejects one or more droplets of a fluid from the pumping chambers. The drive electronics 233 are coupled to the PZT member 234. During operation of the ink jet module 210, the drive electronics 233 drive the PZT member 234 with a low power multi-pulse waveform having at least two drive pulses and at least one intermediate portion to cause the PZT member 234 to eject one or more droplets of the fluid from the pumping chamber in response to the pulses of the multi-pulse waveform. In the case of a single droplet, the droplet can be formed of one or more sub-drops depending on the number of pulses in the multi-pulse waveform, and the sub-drops can be connected, such that they break-off from the orifice together. At least one intermediate portion has a voltage level greater than zero and less than a threshold voltage level in order to reduce the power needed to operate the ink jet module 210. The drive pulses and intermediate portions alternate in time in order to vary the pressure of the pumping chamber and eject the droplets.

In one embodiment, the droplet ejection device ejects additional droplets of the fluid in response to the pulses of the multi-pulse waveform or in response to pulses of additional multi-pulse waveforms. A waveform may include a series of sections that are concatenated together. Each section may include a certain number of samples that include a fixed time period (e.g., 1 to 3 microseconds) and associated amount of data. The time period of a sample is long enough for control logic of the drive electronics to enable or disable each jet nozzle for the next waveform section. The waveform data is stored in a table as a series of address, voltage, and flag bit samples and can be accessed with software. A waveform provides the data necessary to produce a single sized droplet and various different sized droplets.

Figure 8:
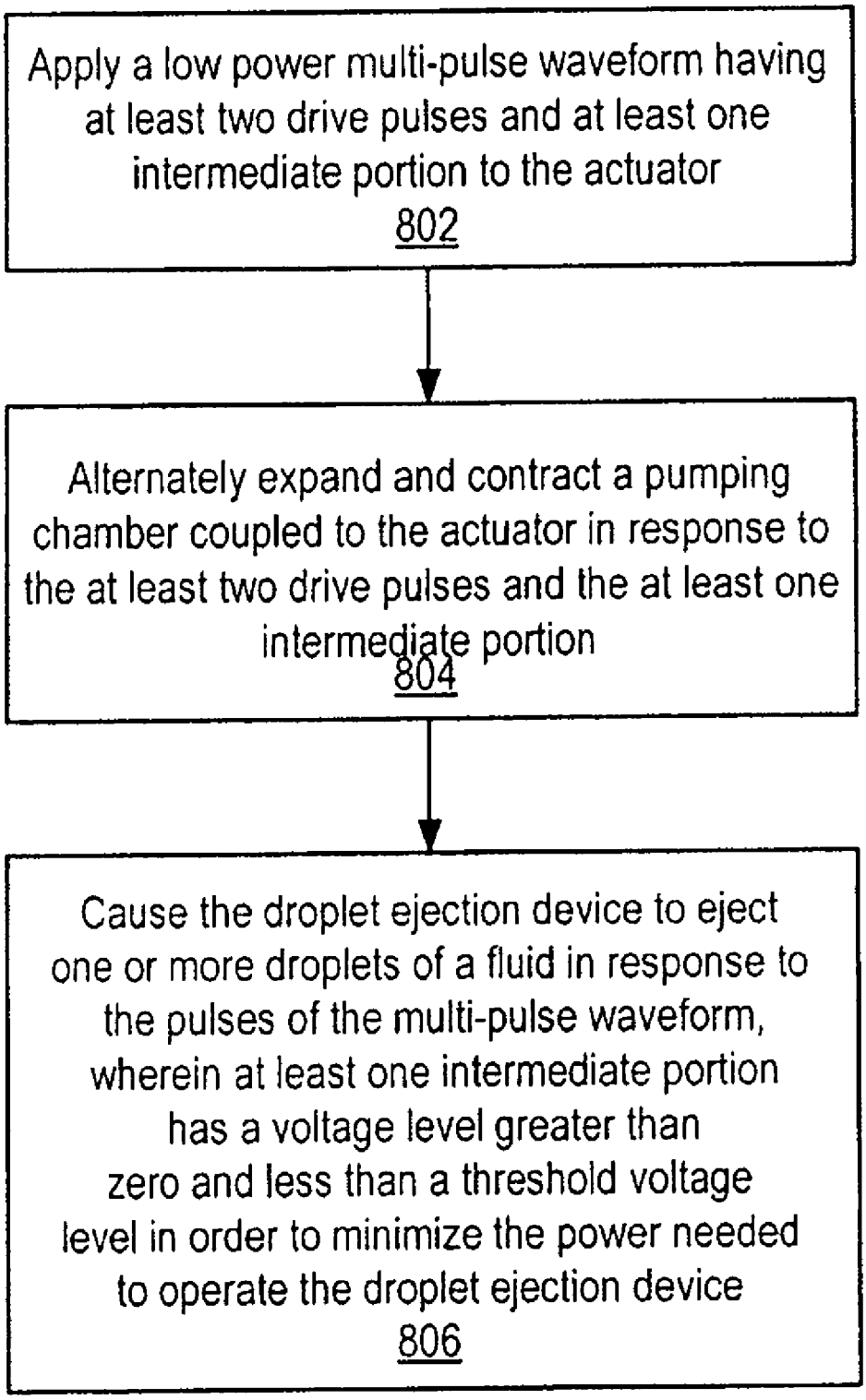
FIG. 8 illustrates a flow diagram of an embodiment for driving a droplet ejection device with a low power multi-pulse waveform.

FIG. 8 illustrates a flow diagram of a process for driving a droplet ejection device with a low power multi-pulse waveform in accordance with one embodiment. The process for driving a droplet ejection device having an actuator includes applying a low power multi-pulse waveform having at least two drive pulses and at least one intermediate portion to the actuator at processing block 802. The process also includes alternately expanding and contracting a pumping chamber coupled to the actuator in response to the at least two drive pulses and the at least one intermediate portion at processing block 804. In one embodiment, the pumping chamber can expand during the rise time of each drive pulse and contract during the fall time of each drive pulse. If the waveform is inverted, then the expansion can occur during the fall time and the contraction can occur during the rise time. Next, the process includes causing the droplet ejection device to eject one or more droplets of a fluid in response to the pulses of the multi-pulse waveform at processing block 806. In some embodiments, at least one intermediate portion has a voltage level greater than zero and less than or equal to a threshold voltage level in order to reduce the power needed to operate the droplet ejection device. The power needed to eject the fluid is reduced by reducing a total magnitude of a first voltage change between a peak voltage of the first drive pulse and the voltage level of the intermediate portion and also a second voltage change between the voltage level of the intermediate portion and a peak voltage of the second drive pulse.

Figure 9:
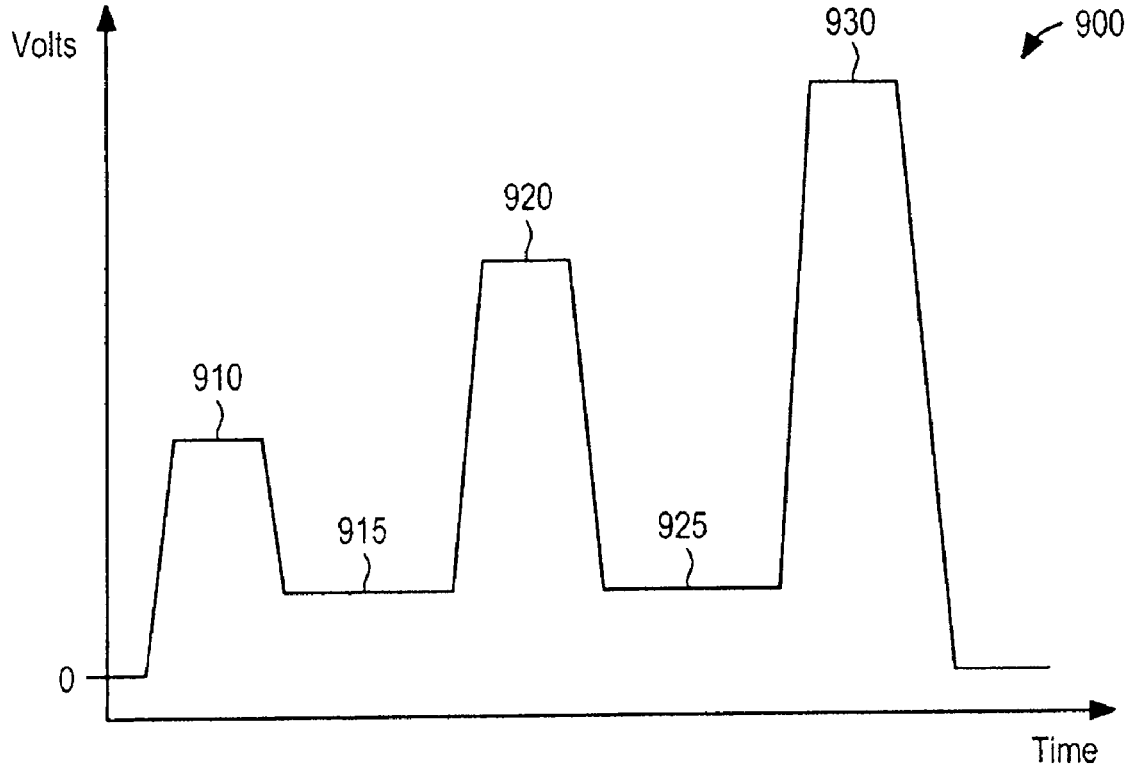
FIG. 9 illustrates a low power multi-pulse waveform with three drive pulses and two intermediate portions in accordance with one embodiment.

FIG. 9 illustrates a low power multi-pulse waveform with three drive pulses and two intermediate portions in accordance with one embodiment. The low power multi-pulse waveform 900 includes three drive pulses 910, 920, and 930 and two intermediate portions 915 and 925 as illustrated in FIG. 9. In contrast to the waveform 100 illustrated in FIG. 1, these intermediate portions 915 and 925 are greater than zero in order to reduce the change in voltage in switching from a drive pulse to an intermediate portion and vice versa. The intermediate portions 915 and 925 are also set below or equal to threshold voltage levels. A first threshold voltage level is greater than or equal to a voltage level of the intermediate portion 915 and a second threshold voltage level is greater than or equal to a voltage level of the intermediate portion 925. The first threshold voltage level is based on peak voltages associated with the drive pulses 910 and 920. The first threshold voltage level is less than the lower of the peak voltages associated with the drive pulses 910 and 920 such that the actuator properly varies the pressure in the pumping chamber to eject fluid from the pumping chamber. In a similar manner, the second threshold voltage level is based on peak voltages associated with the drive pulses 920 and 930. The second threshold voltage level is less than the lower of the peak voltages associated with the drive pulses 920 and 930. For one embodiment, the low voltages pulses 915 and 925 are both set equal to a certain percentage (e.g., 27%) of the maximum waveform voltage.

The actuator distorts and changes the pressure in the pumping chamber to eject the fluid in response to various voltage pulses and voltage changes applied by the waveform. The intermediate portions of a waveform create the pumping action to drive the sub-drops that form into an overall larger drop. It is not necessary for the voltage and therefore the action of the pressure actuator to reach the full minimum or maximum in order to generate the effect required for the drop formation. The power needed to fire a jetting array can be a function of frequency, supply voltage, waveform voltages, and the total magnitude change in voltage between the pulses. By reducing the magnitude of the change between drive pulses and intermediate portions, the overall power to fire a jet can be reduced. The peak voltage of the drive pulse 910 is less than the peak voltage of the drive pulse 920 which is less than the peak voltage of the drive pulse 930 in order to eject a droplet having a mass greater than 50 nanograms (ng).

In another embodiment, the low power waveform 900 operating at a frequency of 14 kilohertz (kHz) can produce a 80 ng drop and consume 20 watts of power. By contrast, the waveform 100 operating at a frequency of 14 kilohertz (kHz) can produce a 80 ng drop and consume 26 watts of power. For a 80 ng drop, the waveform 900 has a 23 percent savings in power compared to the waveform 100. The low power waveform 900 produces a firing voltage, drop mass, frequency response, and drop formation that is similar or equivalent to the firing voltage, drop mass, frequency response, and drop formation of the waveform 100.

Figure 10:
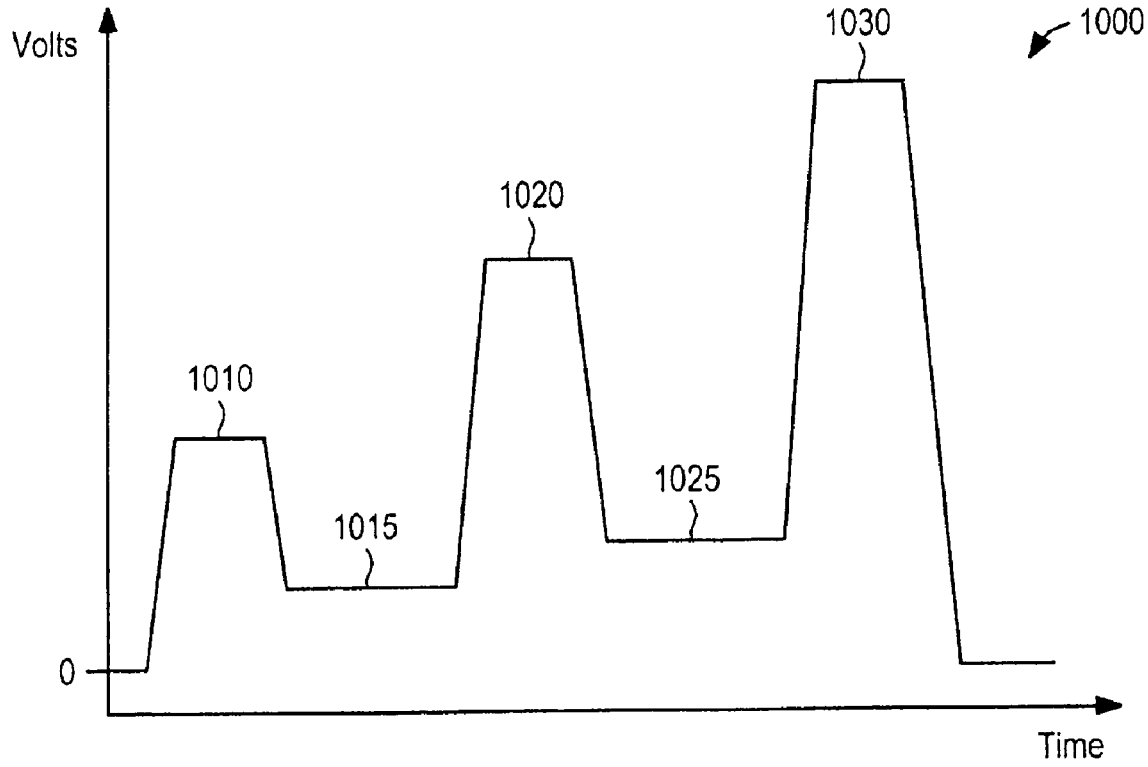
FIG. 10 illustrates a low power multi-pulse waveform with three drive pulses and two intermediate portions in accordance with another embodiment.

FIG. 10 illustrates a low power multi-pulse waveform with three drive pulses and two intermediate portions in accordance with another embodiment. The low power multi-pulse waveform 1000 includes three drive pulses 1010, 1020, and 1030 and two intermediate portions 1015 and 1025 similar to the drive pulses and intermediate portions of the waveform 900. However, the intermediate portion 1015 has a voltage level lower than the voltage level of the intermediate portion 1025.

Figure 11:
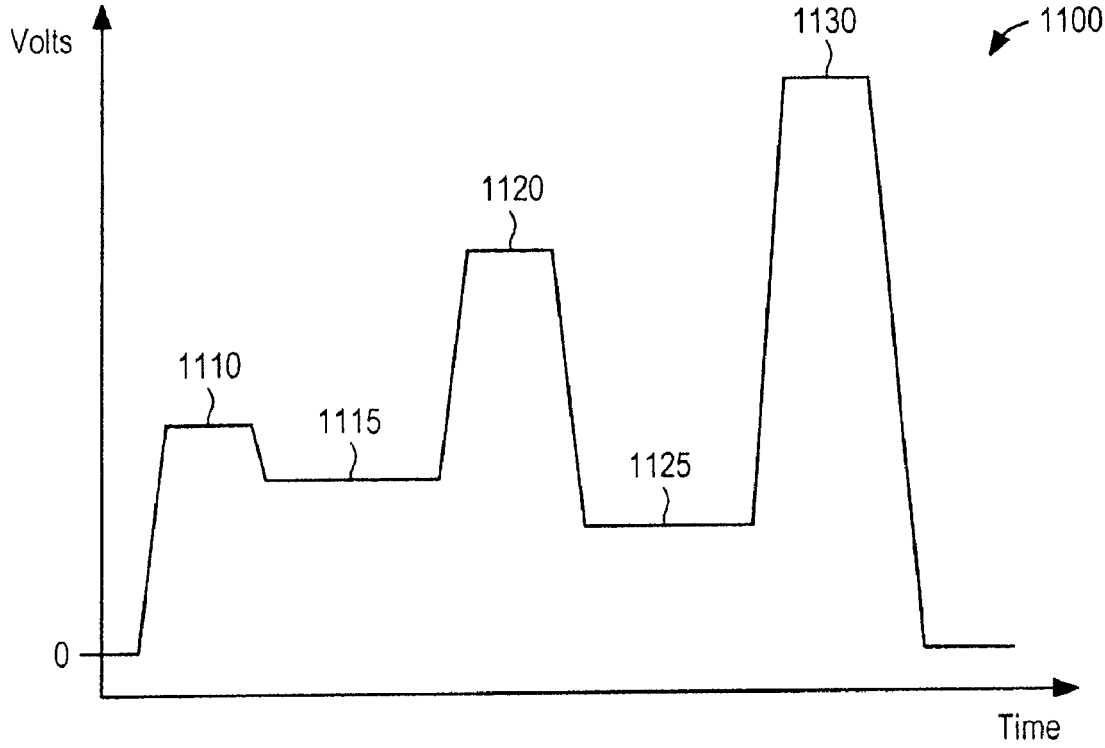
FIG. 11 illustrates a multi-pulse waveform with three drive pulses and two intermediate portions in accordance with another embodiment.

FIG. 11 illustrates a multi-pulse waveform with three drive pulses and two intermediate portions in accordance with another embodiment. The low power multi-pulse waveform 1100 includes three drive pulses 1110, 1120, and 1130 and two intermediate portions 1115 and 1125 similar to the drive pulses and intermediate portions of the waveforms 900 and 1000. However, the intermediate portion 1115 has a voltage level higher than a voltage level of the intermediate portion 1125. The waveforms 900, 1000, and 1100 can generate large droplets (e.g., 80 ng) with reduced power consumption. Altering the voltage levels of the intermediate portions with respect to the peak voltages of the drive pulses alters the power consumed in ejecting droplets.

Figure 12:
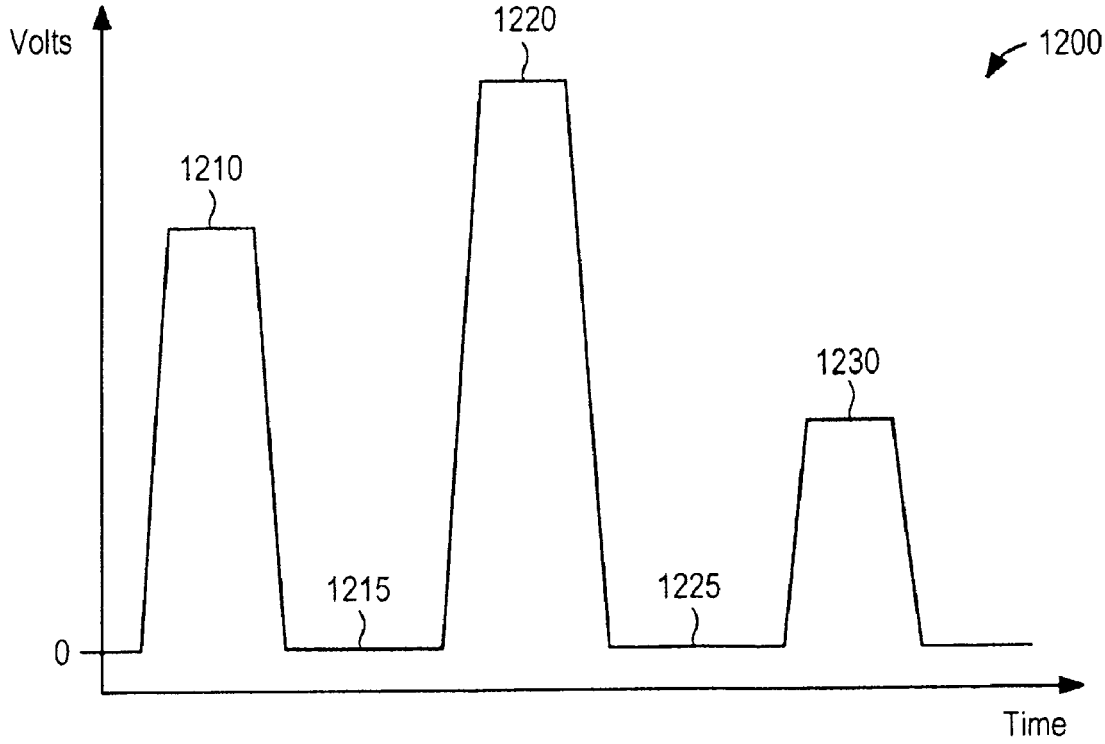
FIG. 12 illustrates a multi-pulse waveform with three drive pulses and two intermediate portions in accordance with another embodiment.

FIG. 12 illustrates a multi-pulse waveform with three drive pulses and two intermediate portions in accordance with another embodiment. The multi-pulse waveform 1200 includes three drive pulses 1210, 1220, and 1230 and two intermediate portions 1215 and 1225 as illustrated in FIG. 12. The voltage of the intermediate portions 1215 and 1225 is approximately equal to zero. The voltage of the waveform 1200 applied to an actuator (e.g., PZT member) decreases from a peak voltage of pulse 1210 to zero and then increases to a peak voltage of pulse 1220. Next, the voltage decreases to zero and then increases to a peak voltage of pulse 1230. The peak voltage of the drive pulse 1230 is less than the peak voltage of the drive pulse 1210 which is less than the peak voltage of the drive pulse 1220 in order to eject a droplet having a mass less than 50 ng with a low tail mass.

In another embodiment, the waveform 1200 operating at a frequency of 30 kHz can produce a 30 ng drop and consume 62 watts of power. The waveform 1200 builds a drop that would otherwise be 40-50 ng with the pulses 1210 and 1220. Then the waveform 1200 uses the pulse 1230 to rapidly initiate break-off of the tail of the droplet.

Figure 13:
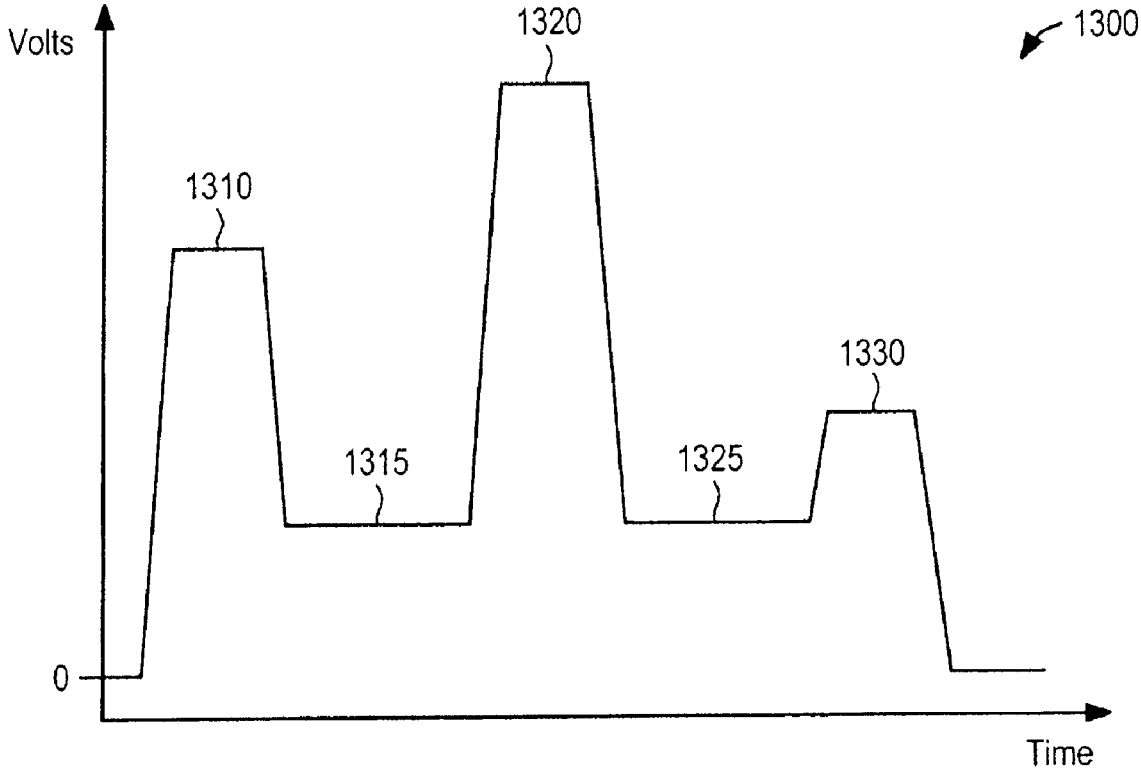
FIG. 13 illustrates a low power multi-pulse waveform with three drive pulses and two intermediate portions in accordance with another embodiment.

FIG. 13 illustrates a low power multi-pulse waveform with three drive pulses and two intermediate portions in accordance with another embodiment. The low power multi-pulse waveform 1300 includes three drive pulses 1310, 1320, and 1330 and two intermediate portions 1315 and 1325 as illustrated in FIG. 13. In contrast to the waveform 1200 illustrated in FIG. 12, these intermediate portions 1315 and 1325 are greater than zero in order to reduce the change in voltage in switching from a drive pulse to a intermediate portion and vice versa. The intermediate portions 1315 and 1325 are set below or equal to threshold voltage levels. A first threshold voltage level is greater than or equal to a voltage level of the intermediate portion 1315 and a second threshold voltage level is greater than or equal to a voltage level of the intermediate portion 1325. The first threshold voltage level is based on peak voltages associated with the drive pulses 1310 and 1320. The first threshold voltage level is less than the lower of the peak voltages associated with the drive pulses 1310 and 1320 in order for the proper ejection of the fluid in the pumping chamber.

In a similar manner, the second threshold voltage level is based on peak voltages associated with the drive pulses 1320 and 1330. The second threshold voltage level is less than the lower of the peak voltages associated with the drive pulses 1320 and 1330. For one embodiment, the voltage levels of intermediate portions 1315 and 1325 are both set equal to a certain percentage (e.g., 27%) of the maximum waveform voltage. For another embodiment, the voltage levels of the intermediate portion 1315 and 1325 are set to different voltages and thus different percentages (e.g., 21%, 27%) of the maximum waveform voltage.

Figure 14:
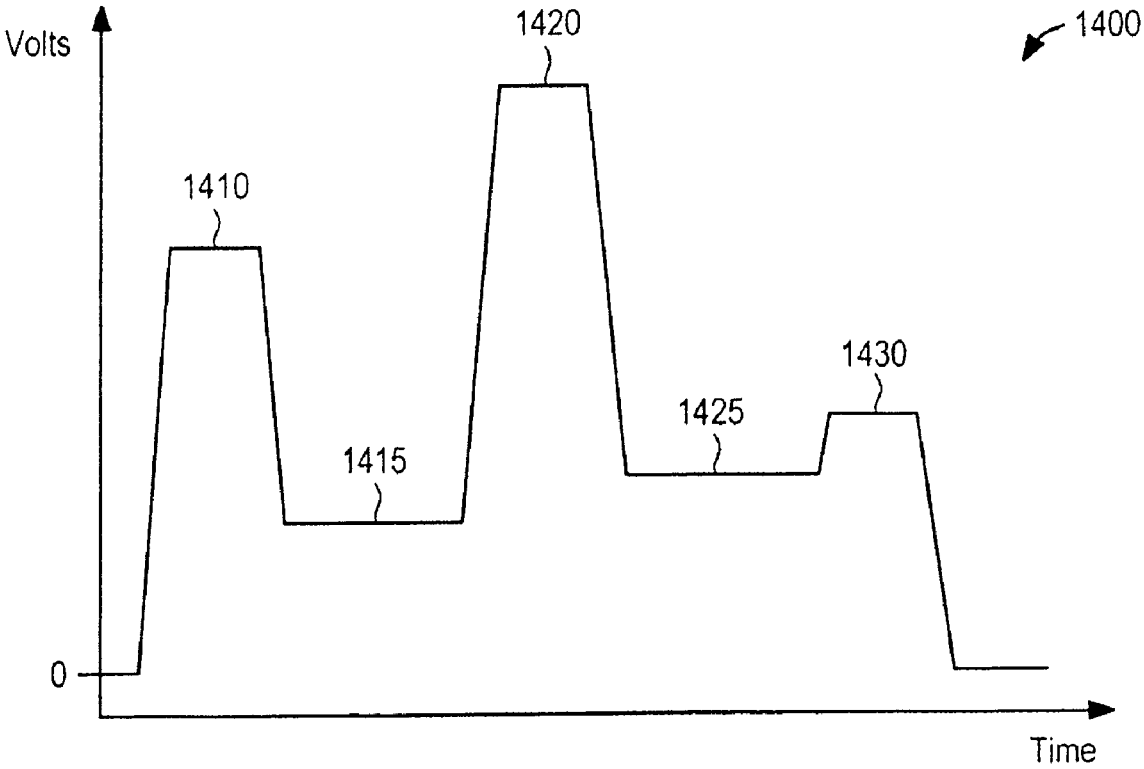
FIG. 14 illustrates a multi-pulse waveform with three drive pulses and two intermediate portions in accordance with another embodiment.

FIG. 14 illustrates a multi-pulse waveform with three drive pulses and two intermediate portions in accordance with another embodiment. The low power multi-pulse waveform 1400 includes three drive pulses 1410, 1420, and 1430 and two intermediate portions 1415 and 1425 similar to the drive pulses and intermediate portions of the waveform 1300. However, the intermediate portion 1415 has a voltage level lower than the voltage level of the intermediate portion 1425.

Figure 15:
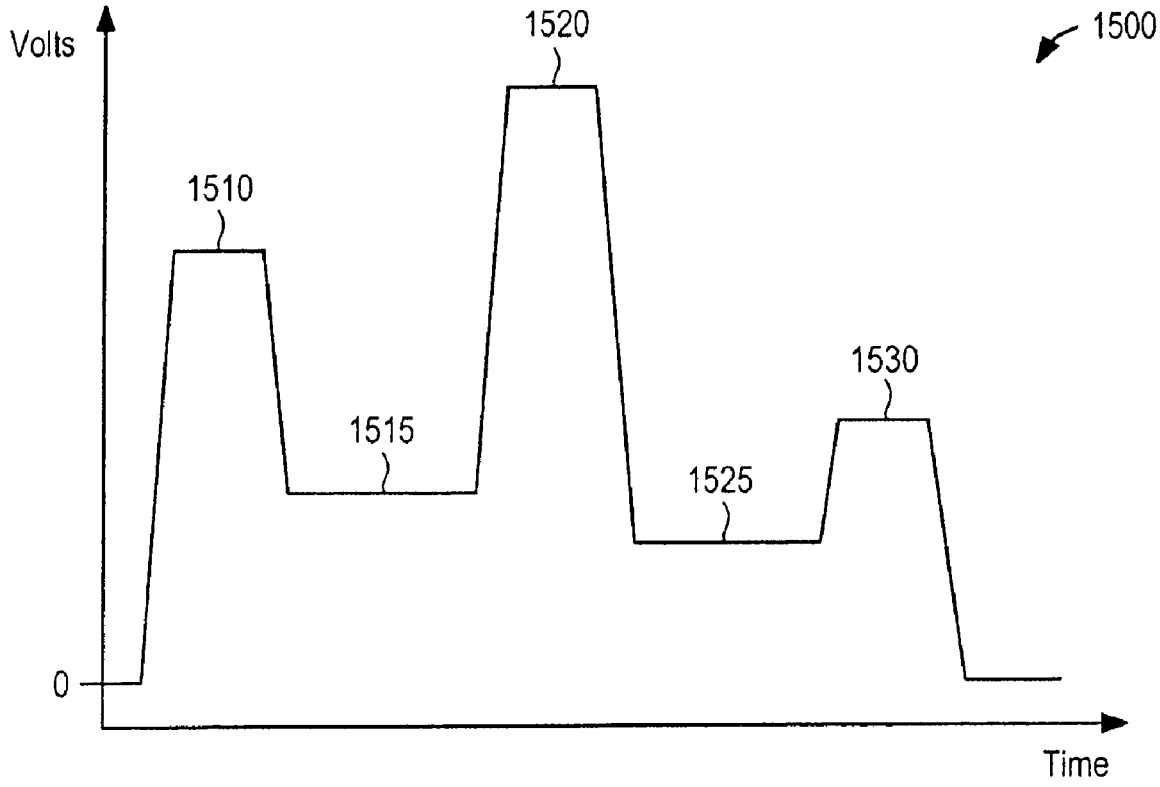
FIG. 15 illustrates a low power multi-pulse waveform with three drive pulses and two intermediate portions in accordance with another embodiment.

FIG. 15 illustrates a multi-pulse waveform with three drive pulses and two intermediate portions in accordance with another embodiment. The low power multi-pulse waveform 1500 includes three drive pulses 1510, 1520, and 1530 and two intermediate portions 1515 and 1525 similar to the drive pulses and intermediate portions of the waveforms 1300 and 1400. However, the intermediate portion 1515 has a voltage level higher than the voltage level of the intermediate portion 1525. The waveforms 1300, 1400, and 1500 can generate small droplets (e.g., less than 50 ng) with reduced power consumption. Altering the voltage levels of the intermediate portions with respect to the peak voltages of the drive pulses alters the power consumed in ejecting droplets.

As previously discussed, the power needed to fire a jetting array can be a function of frequency, supply voltage, waveform voltages, and the total magnitude change in voltage between the pulses. By reducing the magnitude of the change in voltage between drive pulses and intermediate portions, the overall power to fire a jet can be reduced. The peak voltage of the drive pulse 1330 is less than the peak voltage of the drive pulse 1310 which is less than the peak voltage of the drive pulse 1320 in order to eject a droplet having a mass less than 50 nanograms with a small tail mass.

In another embodiment, the low power waveform 1300 operating at a frequency of 30 kHz can produce a 30 ng drop and consume 49 watts of power. The waveform 1200 operating at a frequency of 30 kHz can produce a 30 ng drop and consume 62 watts of power. For a 30 ng drop, the waveform 1300 has a 21 percent savings in power compared to the waveform 1200. The low power waveform 1300 produces a firing voltage, drop mass, frequency response, and drop formation that is similar or equivalent to the firing voltage, drop mass, frequency response, and drop formation of the waveform 1200.

For certain embodiments, other types of pulses, drop shaping sub-pulses, or completely different pulses can be used in creating a low power waveform having the ability to produce various types and sizes of droplets. The low power waveform increases peak voltages for intermediate portions greater than zero and less than a threshold voltage level in order to reduce the voltage change between drive pulses and intermediate portions while still maintaining proper jetting operation.

It is to be understood that the above description is intended to be illustrative, and not restrictive. Many other embodiments will be apparent to those of skill in the art upon reading and understanding the above description. The scope of the invention should, therefore, be determined with reference to the appended claims, along with the full scope of equivalents to which such claims are entitled.

What is claimed is:

1. A method for driving a droplet ejection device having an actuator, comprising:

applying a low power multi-pulse waveform having at least three drive pulses and at least two intermediate portions to the actuator; and causing the droplet ejection device to eject a droplet of a fluid in response to the drive pulses of the low power multi-pulse waveform, wherein a first intermediate portion has a voltage level greater than zero and less than or equal to a first threshold voltage level and a second intermediate portion has a voltage level greater than zero and less than or equal to a second threshold voltage level, wherein the peak voltage of the first drive pulse is less than the peak voltage of the second drive pulse which is less than the peak voltage of the third drive pulse.

2. The method of claim 1, further comprising:

alternately expanding and contracting a pumping chamber coupled to the actuator in response to the at least three drive pulses with the expanding occurring in response to a rise time of each drive pulse and the contracting occurring in response to a fall time of each drive pulse.

3. The method of claim 1, wherein the power to eject the fluid is reduced by reducing a total magnitude of a first voltage change between a peak voltage of the first drive pulse and the voltage level of the first intermediate portion and also a second voltage change between the voltage level of the first intermediate portion and a peak voltage of the second drive pulse.

4. The method of claim 1, wherein the multi-pulse waveform comprises three drive pulses and two intermediate portions.

5. The method of claim 1, wherein the first threshold voltage level is based on peak voltages associated with the first and second drive pulses with the first threshold voltage level being less than the lower of the peak voltages associated with the first and second drive pulses.

6. The method of claim 4, wherein the second threshold voltage level is based on peak voltages associated with the second and third drive pulses with the second threshold voltage level being less than the lower of the peak voltages associated with the second and third drive pulses.

7. A method for driving a droplet ejection device having an actuator, comprising:

applying a low power multi-pulse waveform having at least two drive pulses and at least one intermediate portion to the actuator; and causing the droplet ejection device to eject one or more droplets of a fluid in response to the drive pulses of the low power multi-pulse waveform, wherein the at least one intermediate portion has a voltage level greater than zero and less than or equal to a threshold voltage level to reduce the power needed to operate the droplet ejection device wherein the multi-pulse waveform comprises three drive pulses and two intermediate portions with a first threshold voltage level being greater or equal to the voltage level of the first intermediate portion and a second threshold voltage level being greater or equal to a voltage level of the second intermediate portion, wherein the peak voltage of the first drive pulse is less than the peak voltage of the second drive pulse which is less than the peak voltage of the third drive pulse in order to eject a droplet having a mass greater than 50 nanograms (ng).

8. The method of claim 4, wherein the peak voltage of the third drive pulse is less than the peak voltage of the first drive pulse which is less than the peak voltage of the second drive pulse in order to eject a droplet having a mass less than 50 nanograms (ng) that is a reduced tail mass.

9. The method of claim 2, wherein the actuator operates to vary the pressure of the fluid in the pumping chamber in response to the pulses.

10. An apparatus, comprising:

an actuator to eject one or more droplets of a fluid from a pumping chamber; and drive electronics coupled to the actuator, wherein during operation the drive electronics drive the actuator with a multi-pulse waveform having at least three drive pulses and at least two intermediate portions to cause the actuator to eject a droplet of the fluid from the pumping chamber in response to the pulses of the multi-pulse waveform, wherein a first intermediate portion has a voltage level greater than zero and less than a first threshold voltage level and a second intermediate portion has a voltage level greater than zero and less than a second threshold voltage, wherein the peak voltage of the first drive pulse is less than the peak voltage of the second drive pulse which is less than the peak voltage of the third drive pulse.

11. The apparatus of claim 10, wherein the first threshold voltage level is based on peak voltages associated with the first and second drive pulses with the first threshold voltage level being less than the lower of the peak voltages associated with the first and second drive pulses.

12. The apparatus of claim 10, wherein the second threshold voltage level is based on peak voltages associated with the second and third drive pulses with the second threshold voltage level being less than the lower of the peak voltages associated with the second and third drive pulses.

13. The apparatus of claim 10, wherein the first threshold voltage level is not equal to the second threshold voltage level.

14. The apparatus of claim 10, wherein the actuator operates to vary the pressure of the fluid in the pumping chamber in response to the pulses.

15. A printhead, comprising:

an ink jet module that comprises, an actuator to eject one or more droplets of a fluid from a pumping chamber; and drive electronics coupled to the actuator, wherein during operation the drive electronics drive the actuator with a low power multi-pulse waveform having at least three drive pulses and at least two intermediate portions to cause the actuator to eject a droplet of the fluid from the pumping chamber in response to the pulses of the low power multi-pulse waveform, wherein a first intermediate portion has a voltage level greater than zero and less than a first threshold voltage level and a second intermediate portion has a voltage level greater than zero and less than a second threshold voltage level, wherein the peak voltage of the first drive pulse is less than the peak voltage of the second drive pulse which is less than the peak voltage of the third drive pulse.

16. The printhead of claim 15, wherein the drive pulses and intermediate portions alternate in time in order to vary the pressure of the pumping chamber.

17. The printhead of claim 16, wherein each intermediate portion is associated with a threshold voltage level.

18. The printhead of claim 15, wherein each respective threshold voltage level is based on peak voltages of drive pulses that occur immediately prior to and subsequent to a respective intermediate portion that is associated with the respective threshold voltage level.

19. The printhead of claim 18, wherein each threshold voltage level is less than the lower of the peak voltages associated with drive pulses that occur immediately prior to and subsequent to the associated intermediate portion.

20. The printhead of claim 15, wherein the ink jet module further comprises: a carbon body, a stiffener plate, a cavity plate, a first flex print, a nozzle plate, an ink fill passage, and a second flex print.

* * * * *